US005761581A

United States Patent [19]

Nojima

[11] Patent Number: 5,761,581

[45] Date of Patent: Jun. 2, 1998

[54] IMAGE FORMING APPARATUS CHARGING MEMBER FORMED OF SEQUENTIAL OVERLYING LAYERS OF ELASTIC MATERIAL

[75] Inventor: Kazuo Nojima, Chiba, Japan

[73] Assignee: Ricoh Company, Ltd., Tokyo, Japan

[21] Appl. No.: 655,653

[22] Filed: May 30, 1996

[30] Foreign Application Priority Data

May 30, 1995 [JP] Japan ..... 7-132453

[51] Int. Cl.[6] ..... G03G 15/02

[52] U.S. Cl. ..... 399/174; 361/221; 361/225; 399/176; 492/48; 492/56

[58] Field of Search ..... 399/174–176; 361/221, 225, 230; 492/48, 49, 56

[56] References Cited

U.S. PATENT DOCUMENTS

| | | | |
|---|---|---|---|
| 5,017,965 | 5/1991 | Hashimoto et al. | 399/176 |
| 5,089,851 | 2/1992 | Tanaka et al. | 399/176 |
| 5,497,219 | 3/1996 | Kurokawa et al. | 399/176 |
| 5,502,548 | 3/1996 | Suzuki et al. | 399/174 X |
| 5,572,294 | 11/1996 | Osawa et al. | 399/174 |
| 5,602,712 | 2/1997 | Daifuku et al. | 361/225 |
| 5,619,311 | 4/1997 | Kurokawa et al. | 399/176 |
| 5,625,858 | 4/1997 | Hirai et al. | 399/176 |

FOREIGN PATENT DOCUMENTS

| | | |
|---|---|---|
| 63-149668 | 6/1988 | Japan . |
| 1-142569 | 6/1989 | Japan . |
| 3-217872 | 9/1991 | Japan . |
| 5-281830 | 10/1993 | Japan . |
| 5-341627 | 12/1993 | Japan . |
| 7-72710 | 3/1995 | Japan . |
| 7-77859 | 3/1995 | Japan . |
| 7-84437 | 3/1995 | Japan . |
| 7-134467 | 5/1995 | Japan . |

*Primary Examiner*—William J. Royer
*Attorney, Agent, or Firm*—Lowe, Price, LeBlanc & Becker

[57] ABSTRACT

A charging member is provided comprising an electroconductive substrate having sequential overlying layers of an elastic material comprising an epichlorohydrin rubber and a surface layer comprising an aqueous polyurethane resin. The resulting composite charging member represses adhesion of toner particles and dirt to the surface thereof, exhibits improved durability, and prevents lowering of the charging potential in a low temperature, low humidity environment.

18 Claims, 3 Drawing Sheets

IMAGE FORMING APPARATUS CHARGING MEMBER FORMED OF SEQUENTIAL OVERLYING LAYERS OF ELASTIC MATERIAL

TECHNICAL FIELD

The present invention relates to a charging member for use in an electrophotographic apparatus and a charging device containing the charging member. More particularly, the present invention relates to a charging member comprising an electroconductive substrate and an elastic layer formed mainly of epichlorohydrin rubber overlying the substrate.

BACKGROUND ART

In a conventional electrographic image forming apparatus, a corona discharge device has been widely used to uniformly charge the entire surface of a photoconductive member. A corona discharge device is effective for uniformly charging the photoconductive member to a prescribed potential. Unfortunately, charging by means of corona discharge requires a high-voltage power source and, disadvantageously, results in the generation of ozone which adversely affects the environment and deteriorates the charging member and the photoconductive member.

The contact roller charging method comprising holding a charging roller (charging member) in contact with a photoconductive member and applying a voltage thereto while maintaining them in mutually reverse rotation, thereby charging the surface of the photoconductive member has been developed for commercial operation. Though this method is advantageous in permitting the use of a low voltage power source and allowing reduction in the volume of ozone generated, it is inferior to the corona discharge method in terms of charging uniformity.

The "method for contact charging" disclosed in JP-A-63-149,668, for example, is said to bring about an appreciable improvement in charging uniformity by causing an AC voltage having a peak-to-peak voltage of not less than twice the voltage existing at the start of the charging to overlap the DC voltage being applied to the site of contact charging. This contact charging method, which implements the necessary charging by applying a voltage produced by overlapping the AC voltage on the DC voltage, however, disadvantageously imparts to the environment an objectionable sensation by the charging noise arising from the mechanical vibration of the charging device ascribable to the AC voltage, entailing consumption of an unduly large amount of the AC voltage, and inevitably sacrificing the merit of repressing the generation of ozone.

These disadvantages can be eliminated by relying solely on the application of DC voltage to the charging device for charging; however, uniformity of charging is not easily obtained. JP-A-05-341,627 discloses the use of an epichlorohydrin rubber exhibiting semiconducting properties in an elastic layer of a charging member (charging roller), thereby improving charging uniformity and the withstanding voltage of charging and, as a result, decreasing the amount of generated ozone to 1/30 to 1/50 of the amount generated when the AC voltage is overlapped.

JP-A-07-72710 discloses a charging member which improves uniformity of charging and charging noise, wherein a smooth functional (or surface) layer, including an aqueous polymeric compound, is formed on a sponge (or elastic) layer having medium resistance.

Though the conventional charging member has superposed on a semiconductor elastic layer a nonviscous surface layer, toner particles, paper dirt, etc. are ultimately deposited on the surface of the charging member when the charging member is continuously employed as a charging device for a copying device. It consequently entails problems in terms of durability, such as heightened electric resistance and lowered charging property of the charging member, and uneven charging. For example, toner particles which have slipped past a cleaning unit and remain on the sensitive member adhere to the surface of the charging member held in contact with the sensitive member causing adverse effects, such as those previously mentioned.

The charging member disclosed in JP-A-07-72710 improves charging uniformity by forming a smooth functional layer. However, microscopic charging uniformity is poor, because the functional layer includes an electroconductive filler in addition to an aqueous polymer compound to decrease the electric resistance, thereby generating a microscopic difference in the resistance of the functional layer.

In addition, the aqueous polymer compound employed in the functional layer of the charging member disclosed in JP-A-07-72710 is an emulsified polyurethane resin containing a surfactant as an emulsifier. Aqueous polyurethane resins are roughly classified into two types. The first type is an emulsified polyurethane resin including a surfactant, such as that employed in JP-A-07-72710. The second type is a water-soluble or a water-dispersible polyurethane resin which has a hydrophilic group or segment therein. The first type has higher electric resistance than the second type, so that the resin requires an electroconductive material, such as an electroconductive filler, to decrease the electric resistance for use in the contact charging member. Further when using an emulsified resin containing a surfactant in the functional layer, the surfactant bleeds on the surface of the functional layer, and contaminates the photoconductive member, thereby deteriorating the quality of the resulting image.

The electric resistance of the epichlorohydrin rubber used in the elastic layer has very little dependence on humidity, but significant dependence on temperature. When the elastic layer is used in an environment in which the temperature is relatively low, the electric resistance thereof is increased and the charging potential thereof is lowered. This problem will be described in detail below.

The change of the electric resistance is very small over the range of from normal temperature—normal humidity of about 20° C. and about 60% (hereinafter referred to as "M environment") to the high temperature—high humidity of about 30° C. and about 90% (hereinafter referred to as "H environment"), and it is increased by about one order over the range from the M environment to the low temperature—low humidity of about 10° C. and about 15% (hereinafter referred to as "L environment"). As a result, the charging potential is inevitably lowered in the L environment.

The solution to this problem requires a procedure which comprises detecting the temperature of the surface of the roller and correcting the charging potential by application of a voltage commensurate with the detected temperature. This procedure disadvantageously involves an increase in the cost of the charging member.

SUMMARY OF THE INVENTION

Accordingly, it is an object of the present invention to provide a charging member having uniform electric resistance, particularly, of the surface layer, and the ability to uniformly charge a member.

A further object of the present invention is to improve the durability of a charging member and, at the same time, prevent the charging potential from being lowered in the L environment by preventing the adhesion of toner particles and other dirt to the surface of the charging member without entailing an increase in cost.

To accomplish the objects described above, a charging member is provided comprising an electroconductive substrate with an elastic layer thereon having medium electric resistance, wherein there is further provided on the elastic layer a surface layer formed of an aqueous polyurethane resin having a hydrophilic group or segment therein.

In an embodiment of the present invention, the elastic layer includes a polar rubber, such as epichlorohydrin, nitrile, urethane, chloroprene and acrylic rubber.

In another embodiment according to the present invention, the charging member comprises an electroconductive substrate, and an elastic layer formed on the electroconductive substrate which comprises an epichlorohydrin rubber, wherein a surface layer comprising an aqueous polyurethane resin having a hydrophilic group or segment therein is further formed on the elastic layer.

In another embodiment according to the present invention, the epichlorohydrin rubber is an epichlorohydrin-ethylene oxide-allyl glycidyl ether ternary copolymer rubber and has a ratio of combination (mol %) of epichlorohydrin/ethylene oxide/allyl glycidyl ether in the range of from 40/58/2 to 60/32/8.

A charging device according to yet another embodiment of the present invention holds the charging member in contact with an image-carrying material and applies a DC voltage to the electroconductive substrate.

Additional objects and advantages of the present invention will become readily apparent to those skilled in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE INVENTION

Figure 1:
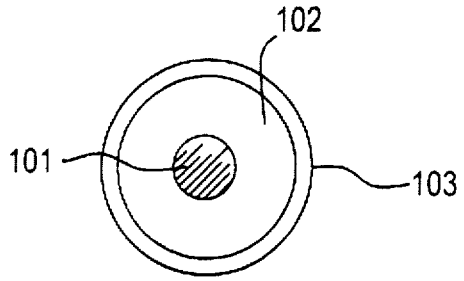
FIG. 1 is an explanatory diagram showing an example of the shape and structure of the charging member of this invention.

A charging member according to the present invention comprises an electroconductive substrate with an overlying elastic layer having medium electric resistance. In addition, there is further provided on the elastic layer a surface layer formed of an aqueous polyurethane resin having a hydrophilic group or segment therein. The polyurethane resin has medium volume resistivity, so that the surface layer needs no electroconductive filler and, accordingly, it is capable of uniform charging. The polyurethane resin also has no surfactant such as emulsifier and dispersant, so that there is no bleeding of surfactant on the surface layer and stable charging and image quality are maintained for a long period of time.

A charging member according to the present invention has an elastic layer with medium electric resistance made of a polar rubber having medium volume resistivity, so that the electric resistance of the elastic layer is uniform and it is capable of uniform charging.

A charging member according to the present invention includes an electroconductive substrate, an elastic layer including epichlorohydrin rubber provided thereon, and a surface layer including an aqueous polyurethane resin having a hydrophilic group or segment therein formed on the elastic layer. The epichlorohydrin rubber and the polyurethane resin have medium volume resistivity, enabling uniform charging. The polyurethane resin also has no surfactant, so that there is no bleeding of surfactant on the surface layer, and stable charging and image quality are maintained for a long period of time. In addition, the polyurethane resin has excellent releasability, so that the surface layer prevents the adhesion of toner and dust and, accordingly, stable charging potential and image quality are maintained for a long period of time.

In a charging member of the present invention, the epichlorohydrin rubber employed is an epichlorohydrin-ethylene oxide-allyl glycidyl ether ternary copolymer rubber and has a molar ratio of combination of epichlorohydrin/ethylene oxide/allyl glycidyl ether in the range of 40/58/2~60/32/8. The epichlorohydrin rubber has uniform volume resistivity under various environments and climatic conditions during a year, so that stable charging potential and excellent image quality are obtained even in the first copy of the morning or under various environments and climatic conditions during a year. Further, the manufacturing cost of the charging device is low.

In a charging device of the present invention, a DC voltage is used for application to the electroconductive substrate while the charging member is kept in contact with the image-carrying member. Thus, the charging member decreases the amount of generated ozone, thereby allowing a savings in the cost of power source, resulting in an inexpensive charging device.

Since the charging member of the present invention is provided on the electroconductive substrate thereof with an elastic layer formed mainly of epichlorohydrin rubber and is further provided on the elastic layer with a surface layer formed on the aqueous polyurethane resin, it is capable of repressing the adhesion of toner particles and other dirt to the surface of the charging member and preventing the charge potential thereof from being lowered.

In the charging member of this invention, since the epichlorohydrin rubber is an epichlorohydrin-ethylene oxide-allyl glycidyl ether ternary copolymer rubber and has a ratio of combination (mol %) of epichlorohydrin/ethylene oxide/allyl glycidyl ether in the range of 40/58/2~60/32/8, the charging member is capable of repressing the adhesion of toner particles and other dirt to the surface of the charging member and preventing the charge potential thereof from being lowered.

Since the charging device of this invention, employing the charging member having provided on the electroconductive substrate thereof the elastic layer formed mainly of epichlorohydrin rubber, holds the charging member in contact with an image-carrying material, and applies a DC voltage to the electroconductive substrate, it is capable of decreasing the amount of generated ozone and lowering the cost of the power source.

With respect to the charging member of this invention and the charging device using the charging member:

(1) Examples of the shape and structure of the charging member of this invention;

(2) Examples of the structure of the charging device of this invention; and (3) Example 1 through Example 5;

are described below sequentially in the order mentioned with reference to the drawings.

(1) Examples of the shape and structure of the charging member of this invention.

First, examples of the shape of the charging member of this invention will be described. The charging member of this invention, for example, has the shape of a roller as shown in FIG. 1. It is composed of an electroconductive substrate 101 shaped like a metal core, such as a shaft member, an elastic layer 102 overlying the electroconductive substrate 101, and a surface layer 103 formed on the peripheral surface of the elastic layer 102.

Figure 2:
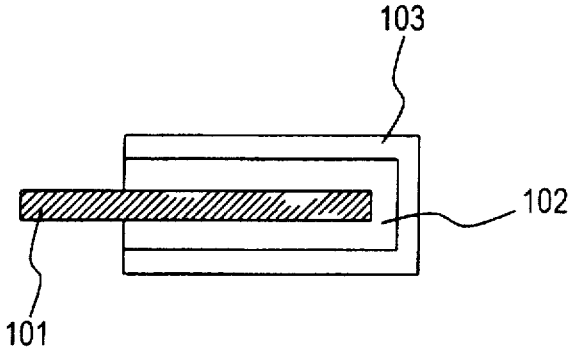
FIG. 2 is an explanatory diagram showing another example of the shape and structure of the charging member of this invention.

The charging member of this invention may also be composed of an electroconductive member 101 in the form of a flat plate, an elastic layer 102 overlying the periphery of the electroconductive substrate 101, and a surface layer 103 formed on the peripheral surface of the elastic layer 102 as shown in FIG. 2. Preferably, in terms of the uniformity of charging, it is in the shape of a roller.

Figure 3:
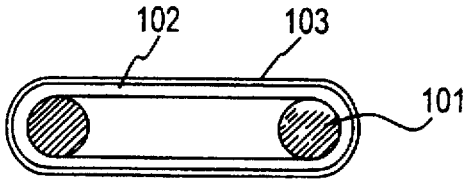
FIG. 3 is an explanatory diagram showing yet another example of the shape and structure of the charging member of this invention.

The charging member of this invention may be alternatively composed of an electroconductive substrate 101 of the shape of a pair of parallel axes, such as a plate member, an elastic layer 102 in the form of an endless belt, and a surface layer 103 formed on the peripheral surface of the elastic layer 102 as shown in FIG. 3.

The charging members of FIG. 1 through FIG. 3 may be provided, when necessary, with adhesive layers capable of enhancing adhesiveness between the electroconductive substrate 101, the elastic layer 102, and the surface layer 103. In the case of the charging member in the shape of a roller, for example, the electroconductive substrate 101 may be treated with an electroconductive primer, such as synthetic rubber having incorporated therein an electroconductive substance such as carbon black.

For the electroconductive substrate 101, metals such as iron, stainless steel, and aluminum, and electroconductive resins such as a carbon black-dispersed resin and a metallic particle-dispersed resin, can be employed. The electroconductive substrate 101 can be appropriately used in the shape of a bar or a plate.

The elastic layer 102 produces excellent results when the volume resistivity thereof is set in the range of $10^7$ to $10^9$ Ω•cm. As the material for the elastic layer 102, therefore, polar rubbers such as epichlorohydrin rubber, nitrile rubber, urethane rubber, chloroprene rubber, and acrylic rubber can be used. Among polar rubbers, epichlorohydrin rubber is advantageous in offering relatively small volume resistivity and exhibiting high stability to withstand environmental conditions.

The epichlorohydrin rubber (acronym: ECO) is known in various forms, such as, for example, ECO homopolymer, copolymer of ECO with ethylene oxide (acronym: EO), copolymer of ECO with allyl glycidyl ether (acronym: AGE), and ternary copolymer of ECO and EO and AGE (acronym: GECO). Among other epichlorohydrin rubber derivatives mentioned above, the GECO proves particularly appropriate in offering relatively small electric resistance and exhibiting high stability to withstand environmental weather conditions.

Figure 4:
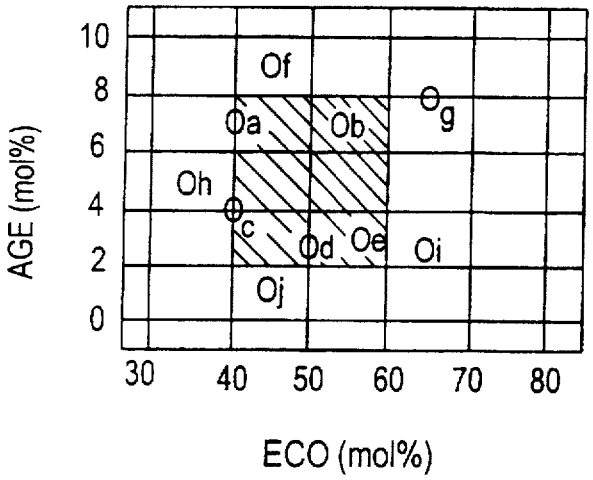
FIG. 4 is an explanatory diagram showing the relation between the AGE content (mol %) and the ECO content (mol %) in the ratio of combination of unit comonomers.

It has been ascertained that the GECO ternary copolymer is particularly effective in curbing the elevation of the electric resistance in the L environment when the ratio of combination (mol %) of unit comonomers falls in the range of 40/58/2~60/32/8 which is indicated by a hatching part in FIG. 4.

Figure 5:
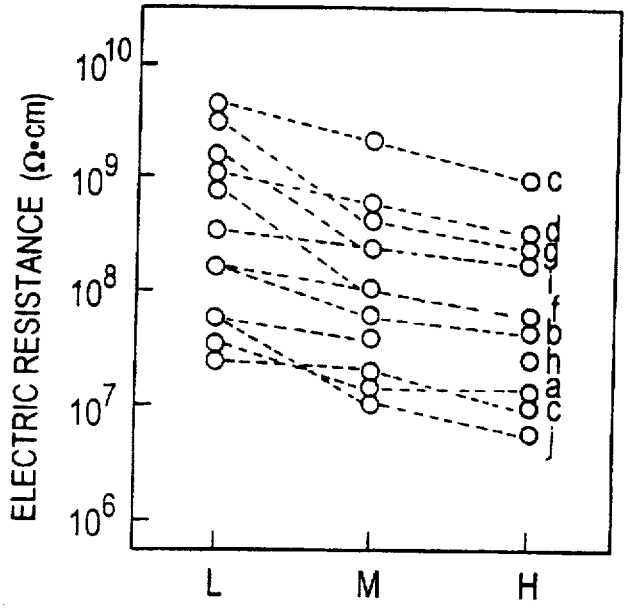
FIG. 5 is an explanatory diagram showing the relation between the three environments (L environment, M environment, and H environment) at varying ratios of combination.

FIG. 4 is a diagram showing the relation between the AGE content (mol %) and the ECO content (mol %) which are ratios of combination of the unit comonomers. The relations between the three environments (L environment, M environment, and H environment) at the ratios of combination shown in FIG. 4 and the relevant magnitudes of electric resistance are shown in FIG. 5.

The elastic layer 102 produces excellent results when the thickness thereof is in the range of 0.5 to 10 mm. The reasons for this particular range is as follows. If the thickness of the elastic layer 102 is less than 0.5 mm, this elastic layer 102 will cause dielectric breakdown of the organic sensitive member (acronym: OPC) and impair the stability of charging. When the OPC happens to contain pinholes, it will cause current concentration in the pinholes and tend to induce leakage and, as a result, give rise to horizontal streaks in the resulting image. Conversely, if the thickness of the elastic layer 102 exceeds 10 mm, the elastic layer 102 will entail a decrease in the charging efficiency and necessitate application of an unduly high voltage and, as a result, increase the amount of generated ozone.

It has been determined, on the basis of factors mentioned above, that the use of the aqueous polyurethane resin having a hydrophilic group or segment as the material for the surface layer 103 on the peripheral surface of the elastic layer 102 constitutes an effective means for enabling the surface layer 103 to acquire outstanding freedom from viscosity and wear resistance relative to the toner particles and avoid polluting the OPC and improving the charging member in durability.

The aqueous polyurethane resin to be used for the surface layer 103 is obtained by imparting a hydrophilic group or a hydrophilic segment to the urethane elastomer in a cross-linked structure, thereby converting the urethane elastomer into a water-soluble type or self-dispersing type elastomer. The aqueous polyurethane resin does not contain any surfactant. There are two basic types of such a resin, namely, a reactive type and a non-reactive type, depending on the presence or absence of reactivity. The reactive type has in the structure thereof such reactivity as a blocked isocyanate group and, by an after treatment such as heating, regenerates a free isocyanate group and undergoes a cross-linking reaction. The non-reactive type has no reactive group in the structure and, therefore, is able to form a tough coating film (layer) when dried in a current of air or by application of heat. The reactive type polyurethane resins are produced by Dai-ichi Seiyaku Kogyo Co., Ltd. and marketed under trademark designation of "Elastron" series, and the non-reactive type is produced by the same company and marketed under the trademark designation of "Superflex" series.

The conventional aqueous resin emulsions and latexes, such as vinyl acetate emulsion, ethylene vinyl acetate emulsion, vinyl chloride emulsion, acrylic emulsion, butadiene rubber latex, isoprene rubber latex, styrene-butadiene rubber latex, and chloroprene rubber latex, contain an emulsifier or a dispersant. When the surface layer 103 is formed with these aqueous resin emulsions or latexes, the emulsifier or the dispersant exudes to the surface of the surface layer 103 and pollutes the surface of the OPC. When the surface layer 103 formed with an aqueous resin emulsion or latex is used in an image forming device, therefore, the image forming device disadvantageously degrades the resulting image. The aqueous polyurethane resin mentioned above and employed in the present invention is incapable of polluting the surface of the OPC, because it is a water-soluble polyurethane or a self-dispersing aqueous dispersion of polyurethane which does not contain an emulsifier.

(2) Examples of structure of the charging device of the present invention.

The structure of the charging device of the present invention using the charging member mentioned above will be described below with reference to FIG. 6. In the diagram, reference numeral 601 denotes a charging member of the present invention, employing the charging member of the shape of a roller shown in FIG. 1. Numeral 602 designates a DC power source for applying a DC voltage to the metal core of the charging member 601. The charging device of the present invention comprises charging member 601 and DC power source 602.

Figure 6:
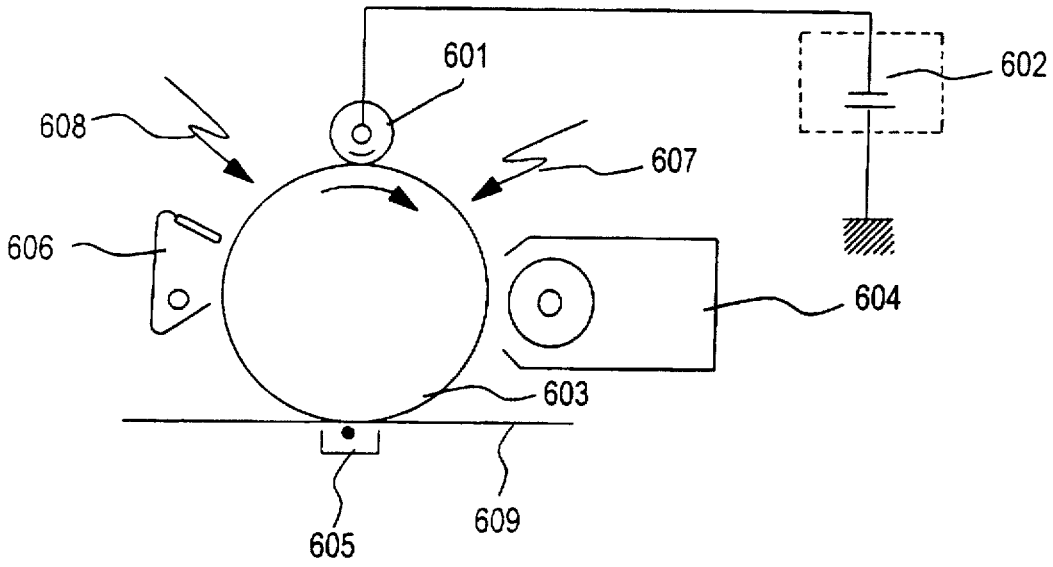
FIG. 6 is an explanatory diagram exemplifying the application of the charging device of this invention to an electrophotographic apparatus.

FIG. 6 depicts the application of the charging device of the present invention to an electrophotographic apparatus. The electrophotographic apparatus has disposed around the peripheral surface of an electrophotographic sensitive member 603, of the shape of a drum, a primary charging member 601, an image exposure device (not shown), a developing unit 604, a transfer charging device 605, a cleaning device 606, and a pre-exposure device (not shown). In the diagram, numeral 607 designates a ray of light emitted from the image exposure device, numeral 608 denotes a pre-exposure light of the pre-exposure device, and numeral 609 designates a target member, such as paper, to which the image is transferred.

The surface of the electrophotographic sensitive member 603, such as OPC, is charged by applying a voltage (such as −1400 V) from the DC power source 602 to the metal core of a primary charging member (charging member 601) disposed on the electrophotographic sensitive member 603 held in contact therewith. The electrophotographic sensitive member 603 is exposed to an image on a subject copy by means of the image exposure device to have a static latent image formed thereon.

The static latent image on the electrophotographic sensitive member 603 is then developed by inducing adhesion of the developer in the developing unit 604 to the electrophotographic sensitive member 603. The developer on the electrophotographic sensitive member 603 is transferred onto the target member 609 for image transfer, such as paper, by the transfer charging device 605. The part of the developer which has escaped being transferred to the paper and remains on the electrophotographic sensitive member 603 is recovered by cleaning device 606. When electrophotographic sensitive member 603 contains a residual charge thereon, the electrophotographic sensitive member 603 is relieved of the residual charge by the exposure device mentioned above before it is subjected to primary charging by the charging member 601.

The development of the present invention has been clarified by describing (1) examples of the shape and the structure of the charging member; and (2) examples of the structure of the charging device. The charging member 601 of the present invention attains uniform charging solely by application of a DC voltage; whereas, in conventional charging rollers, which rely for uniform charging on the overlapping of an AC voltage (as disclosed in JP-A-64-73,364 and JP-A-64-73,367, for example) naturally differ widely in terms of the electric properties (R, C) and the stratal composition of the roller. Since the AC voltage overlapping type comprises elastic layer 102 (a layer of rubber having such electroconductive particles as carbon black dispersed therein) and a surface layer having (high) electrical resistance which functions as a capacitor, the electrostatic capacity is large and the effect of the overlapping AC voltage on uniformizing the charging potential is large.

In contrast, in the charging member of the present invention, which relies solely on the application of a DC voltage, since the roller layer functions as a resistance member (and, therefore, has a small electrostatic capacity), the overlapping of an AC voltage has substantially no contribution on the uniformity of charging.

(3) Example 1–Example 5.

Example 1, Example 2, Example 3, Example 4 and Example 5 are presented sequentially in the order mentioned to in describing a charging member of the present invention with reference to the accompanying drawings.

Example 1.

In Example 1, a charging member is manufactured by the following procedure.

A stainless steel metal core 8 mm in diameter is used as the electroconductive substrate 101. Elastic layer 102 is formed of the following composition.

| | |
|---|---|
| GECO type epichlorohydrin (trial product 1 hereinafter described) | 100 parts by weight |
| Light calcium carbonate | 30 parts by weight |
| Sub (produced by Temman Sub Kogyo and marketed under product code of "GT") | 10 parts by weight |
| Zinc white | 5 parts by weight |
| Stearic acid | 0.5 part by weight |
| Vulcanization accelerator (produced by Ouchi Shiko Kagaku and marketed under trademark designation of "Noccellar TT") | 1.0 part by weight |
| Vulcanization accelerator (produced by Ouchi Shiko Kagaku and marketed under trademark designation of "Noccellar DM") | 1.5 parts by weight |
| Vulcanization accelerator (produced by Ouchi Shiko Kagaku and marketed under trademark designation of "Vulnoc R") | 1.0 part by weight |
| Vulcanizer (produced by Tsurumi Kagaku and marketed uhder trademark designation of "Sulfax PMC") | 0.25 part by weight |

The above composition was kneaded to obtain a compound of uniform texture which was evenly deposited on the stainless steel metal core 8 mm in diameter (electroconductive substrate 101) by a die molding technique (primary vulcanization: 150° C.×15 minutes, secondary vulcanization: 155° C.×7 hours) to form a roller-like elastic layer 102 having an outside diameter of 14 mm.

The GECO type epichlorohydrin (trial product 1) was composed of 40 mol % of ECO, 53 mol % of EO, and 7 mol % of AGE. The relation between the AGE content (mol %) and the ECO content (mol %) is indicated by "a" in FIG. 4. The magnitudes of electric resistance offered by this elastic roller under varying environments are indicated by "a" in FIG. 5.

The electric resistance of the roller was determined by allowing the roller to season for 16 hours under a given environment, wrapping a copper foil tape 25.4 mm in width (produced by 3M and marketed under trademark designation of "Scotch No. 1181") around the periphery of the roller, thereby forming an electrode, applying a DC voltage of 1000

V between the metal core of roller and the electrode, measuring the magnitude of current one minute after the application of the DC voltage, and reporting the magnitude of volume resistivity between the metal core and the electrode.

Then, on the elastic roller thus formed, surface layer 103 was formed as follows. An aqueous polyurethane resin was prepared by diluting 100 parts by weight of a nonreactive type polyurethane resin (produced by Dai-ichi Kogyo Seiyaku Co., Ltd. and marketed under trademark designation of "Superflex 107") with 100 parts by weight of water. The resulting solution was deposited on the surface of the elastic roller by immersing the roller in the solution. The applied layer of the solution was dried at 100° C. for 15 minutes to form surface layer 103 having a thickness of 10 μm. The charging roller (charging member) having the surface layer 103 formed as described above on the elastic roller was tested for electric resistance under the M environment. The results are shown in Table 1.

The charging roller (charging member) produced as described above was set in the place of a primary corona charging device in a copying machine of a standard developing system (produced by Ricoh Co., Ltd. and marketed under product code of "FT5500") and pressed into contact with the surface of the OPC drum so as to rotate in a direction opposite to that of the drum. Under application of a DC voltage of −1400 V as a primary charging voltage, the charging roller was continuously operated to produce 5000 copies, several under the M environment and several under the L environment. During the operation, the dark potential of the OPC was measured, the condition of pollution of the surface of the charging roller was examined, and the produced copies were tested and rated for quality.

The results of the testing and rating described above are reported in Table 1. The condition of pollution of the surface of the charging roller, as with toner particles and dirt, was rated on the four-point scale, wherein:

⊙ stands for slight adhesion of toner particles and dirt, which can be easily wiped off;

○ stands for slight persistence of toner particles and dirt on the surface of the roller after wiping;

Δ stands for persistence of toner particles and dirt in the form of a thin film on the surface of the roller after elaborate wiping; and x stands for strong adhesion of toner particles and dirt to the surface of the roller.

TABLE 1

| | Thickness of surface layer (μm) | Ratio of combination | Volume Resistivity of roller ($10^7$ Ω · cm) | Environment | Charging potential (−V) | Condition of pollution of roller surface (rank) | Presence or absence of abnormal image |
|---|---|---|---|---|---|---|---|
| Example 1 | 10 | 40/53/7 | 2.1 | L | 840 | ⊙ | None |
| | | | | M | 850 | ⊙ | None |
| Example 2 | 8 | 52/41/7 | 5.3 | L | 830 | ⊙ | None |
| | | | | M | 840 | ⊙ | None |
| Example 3 | 7 | 40/56/4 | 1.9 | L | 840 | ⊙ | None |
| | | | | M | 850 | ⊙ | None |
| Example 4 | 20 | 50/47.5/2.5 | 43.0 | L | 790 | ⊙ | None |
| | | | | M | 800 | ⊙ | None |
| Example 5 | 4 | 56/41/3 | 108.0 | L | 770 | ⊙ | None |
| | | | | M | 780 | ⊙ | None |
| Comparative Example 1 | 10 | 40/53/7 | 1.5 | L | 840 | x | Uneven density occurred in the form of longitudinal streaks. |
| | | | | M | 855 | × | Uneven density occurred in the form of longitudinal streaks. |
| Comparative Example 2 | 10 | 45/46/9 | 19.5 | L | 760 | ⊙ | Heavy decline of image density |
| | | | | M | 825 | ⊙ | None |
| Comparative Example 3 | 15 | 65/27/8 | 40.8 | L | 740 | ⊙ | Heavy decline of image density |
| | | | | M | 805 | ⊙ | None |
| Comparative Example 4 | 12 | 35/66/5 | 4.1 | L | 750 | ⊙ | Heavy decline of image density |
| | | | | M | 835 | ⊙ | None |
| Comparative Example 5 | 8 | 63/34.5/2.5 | 22.0 | L | 760 | ⊙ | Heavy decline of image density |
| | | | | M | 815 | ⊙ | None |
| Comparative Example 6 | 7 | 45/54/1 | 1.4 | L | 800 | ⊙ | Heavy decline of image density |
| | | | | M | 870 | ⊙ | None |

Example 2.

An elastic roller was produced by following the procedure of Example 1, except that a GECO type epichlorohydrin (produced by Daiso K.K. and marketed under trademark designation of "Epichlomer CG") was used in place of the GECO type epichlorohydrin (trial product 1) for the composition of the elastic layer 102.

This GECO type epichlorohydrin (Epichlomer CG) was composed of 52 mol % of ECO, 41 mol % of EO, and 7 mol % of AGE. The relation between the AGE content (mol %) and the ECO content (mol %) is indicated by "b" in FIG. 4. The electric resistance of the elastic roller under varying environments is indicated by "b" in FIG. 5.

Then, on the elastic roller produced as described above, surface layer 103 was formed as follows. First, an aqueous polyurethane resin was obtained by preparing a resin solution of 100 parts by weight of a reactive type resin (produced by Dai-ichi Kogyo Seiyaku Co., Ltd. and marketed under trademark designation of "Elastron H-3"), 2 parts by weight of a catalyst (produced by Dai-ichi Kogyo Seiyaku Co., Ltd. and marketed under trademark designation of "Elastron Catalyst 64"), and 100 parts by weight of water and adjusting the pH value of this resin solution to be weakly alkaline with 2 wt % of aqueous sodium hydrogencarbonate (or sodium bicarbonate).

The resulting solution was deposited on the surface of the elastic roller by immersing the roller in the solution. The applied layer of the solution was dried at 150° C. for 10 minutes to form surface layer 103 having a thickness of 8 μm.

The charging roller (charging member) having the surface layer 103 formed on the elastic roller was tested for electric resistance under the M environment. It was rated for performance in an actual copying machine in the same manner as in Example 1. The results are shown in Table 1.

Example 3.

An elastic roller was produced by following the procedure of Example 1, except that a GECO type epichlorohydrin (produced in Daiso K.K. and marketed under trademark designation of "Epichlomer CG102") was used in place of the GECO type epichlorohydrin (trial product 1) for the composition of the elastic layer 102.

This GECO type epichlorohydrin (Epichlomer CG) was composed of 40 mol % of ECO, 56 mol % of EO, and 4 mol % of AGE. The relation between the AGE content (mol %) and the ECO content (mol %) is indicated by "c" in FIG. 4. The electric resistance of the elastic roller under varying environments is indicated by "c" in FIG. 5.

Surface layer 103 was formed on the elastic roller produced as described above as follows. First, the same nonreactive aqueous polyurethane resin (Superflex 107) coating material as obtained in Example 1 was used to form the surface layer 103 having a thickness of 7 μm.

The charging roller (charging member) having the surface layer 103 formed on the elastic roller was tested for electric resistance under the M environment. It was rated for performance in an actual copying machine in the same manner as in Example 1. The results are shown in Table 1.

Example 4.

An elastic roller was produced by following the procedure of Example 1, except that a GECO type epichlorohydrin (produced by Nippon Geon Co., Ltd. and marketed under trademark designation of "Zecron 2101") was used in place of the GECO type epichlorohydrin (trial product 1) for the composition of the elastic layer 102.

This GECO type epichlorohydrin (Epichlomer CG) was composed of 50 mol % of ECO, 47.5 mol % of EO, and 2.5 mol % of AGE. The relation between the AGE content (mol %) and the ECO content (mol %) is indicated by "d" in FIG. 4. The electric resistance of the elastic roller under varying environments is indicated by "d" in FIG. 5.

Surface layer 103 was formed on the elastic roller produced as described above as follows. First, the same nonreactive aqueous polyurethane resin (Superflex 107) coating material as obtained in Example 1 was used to form the surface layer 103 having a thickness of 20 μm.

The charging roller having the surface layer 103 formed on the elastic roller was tested for electric resistance under the M environment. It was rated for performance in an actual copying machine in the same manner as in Example 1. The results are shown in Table 1.

Example 5.

An elastic roller was produced by following the procedure of Example 1, except that a GECO type epichlorohydrin (produced by Daiso K.K. and marketed under trademark designation of "Epichlomer CG107") was used in place of the GECO type epichlorohydrin (trial product 1) for the composition of the elastic layer 102.

This GECO type epichlorohydrin (Epichlomer CG) was composed of 56 mol % of ECO, 41 mol % of EO, and 3 mol % of AGE. The relation between the AGE content (mol %) and the ECO content (mol %) is indicated by "e" in FIG. 4. The electric resistance of the elastic roller under varying environments is indicated by "e" in FIG. 5.

Then, on the elastic roller produced as described above, surface layer 103 was formed as follows. First, the same nonreactive aqueous polyurethane resin (Elastron H-3) coating material as obtained in Example 1 was used to form surface layer 103 having a thickness of 4 μm.

The charging roller having the surface layer 103 formed on the elastic roller was tested for electric resistance under the M environment. It was rated for performance in an actual copying machine in the same manner as in Example 1. The results are shown in Table 1.

Comparative Example 1.

For the purpose of comparison, the product of Comparative Example 1 was obtained as follows.

A charging roller was obtained by following the procedure of Example 1, but omitting the formation of a surface layer 103 on the peripheral surface of the elastic roller. It was tested in the same manner as in Example 1. The results are shown in Table 1.

Comparative Example 2.

For the purpose of comparison, the product of Comparative Example 2 was obtained as follows.

An elastic roller was produced by following the procedure of Example 1, except that a GECO type epichlorohydrin (trial product 2 hereinafter described) was used in place of the GECO type epichlorohydrin (trial product 1) for the composition of the elastic layer 102.

This GECO type epichlorohydrin (trial product 2) was composed of 45 mol % of ECO, 46 mol % of EO, and 9 mol % of AGE. The relation between the AGE content (mol %) and the ECO content (mol %) is indicated by "f" in FIG. 4. The electric resistance of the elastic roller under varying environments is indicated by "f" in FIG. 5.

Surface layer 103 was formed on the elastic roller produced as described above, in a thickness of 10 μm, in the same manner as in Example 1.

The charging roller was tested for electric resistance under the M environment and rated for performance in an actual copying machine in the same manner as in Example 1. The results are shown in Table 1.

Comparative Example 3.

For the purpose of comparison, the product of Comparative Example 3 was obtained as follows.

An elastic roller was produced by following the procedure of Example 1, except that a GECO type epichlorohydrin (produced by Nippon Geon Co., Ltd. and marketed under trademark designation of "Zecron") was used in place of the GECO type epichlorohydrin (trial product 1) for the composition of the elastic layer 102.

This GECO type epichlorohydrin (Zecron 3100) was composed of 65 mol % of ECO, 27 mol % of EO, and 8 mol % of AGE. The relation between the AGE content (mol %) and the ECO content (mol %) is indicated by "g" in FIG. 4. The electric resistance of the elastic roller under varying environments is indicated by "g" in FIG. 5.

Surface layer 103 was formed on the elastic roller produced as described above, in a thickness of 15 μm, in the same manner as in Example 1.

The charging roller was tested for electric resistance under the M environment and rated for performance in an actual copying machine in the same manner as in Example 1. The results are shown in Table 1.

Comparative Example 4.

For the purpose of comparison, the product of Comparative Example 4 was obtained as follows.

An elastic roller was produced by following the procedure of Example 1, except that a GECO type epichlorohydrin (trial product 3 hereinafter described) was used in place of the GECO type epichlorohydrin (trial product 1) for the composition of the elastic layer 102.

This GECO type epichlorohydrin (trial product 3) was composed of 35 mol % of ECO, 70 mol % of EO, and 5 mol % of AGE. The relation between the AGE content (mol %) and the ECO content (mol %) is indicated by "h" in FIG. 4. The electric resistance of the elastic roller under varying environments is indicated by "h" in FIG. 5.

Surface layer 103 was formed on the elastic roller produced as described above, in a thickness of 12 μm, in the same manner as in Example 1.

The charging roller was tested for electric resistance under the M environment and rated for performance in an actual copying machine in the same manner as in Example 1. The results are shown in Table 1.

Comparative Example 5.

For the purpose of comparison, the product of Comparative Example 5 was obtained as follows.

An elastic roller was produced by following the procedure of Example 1, except that a GECO type epichlorohydrin (produced by Daiso K.K. and marketed under trademark designation of "Epichlomer CG104") was used in place of the GECO type epichlorohydrin (trial product 1) for the composition of the elastic layer 102.

This GECO type epichlorohydrin (trial produced 3) was composed of 63 mol % of ECO, 34.5 mol % of EO, and 2.5 mol % of AGE. The relation between the AGE content (mol %) and the ECO content (mol %) is indicated by "i" in FIG. 4. The electric resistance of the elastic roller under varying environments is indicated by "i" in FIG. 5.

Surface layer 103 was formed on the elastic roller produced as described above, in a thickness of 8 μm, in the same manner as in Example 1.

The charging roller was tested for electric resistance under the M environment and rated for performance in an actual copying machine in the same manner as in Example 1. The results are shown in Table 1.

Comparative Example 6.

For the purpose of comparison, the product of Comparative Example 6 was obtained as follows.

An elastic roller was produced by following the procedure of Example 1, except that a GECO type epichlorohydrin (trial product 4 hereinafter described) was used in place of the GECO type epichlorohydrin (trial produce 1) for the composition of the elastic layer 102.

This GECO type epichlorohydrin (trial product 4) was composed of 45 mol % of ECO, 54 mol % of EO, and 1 mol % of AGE. The relation between the AGE content (mol %) and the ECO content (mol %) is indicated by "j" in FIG. 4. The electric resistance of the elastic roller under varying environments is indicated by "j" in FIG. 5.

Surface layer 103 was formed on the elastic roller produced as described above, in a thickness of 7 μm, in the same manner as in Example 1.

The charging roller was tested for electric resistance under the M environment and rated for performance in an actual copying machine in the same manner as in Example 1. The results are shown in Table 1.

It is apparent from Examples 1–5 and Comparative Examples 1–6 above that the charging member of the present invention can retain the initial image quality for a long period of time, since it is capable of precluding adhesion of toner particles and dirt to the charging roller and preventing the charging potential from being lowered even under the L environment.

The charging device of this invention allows a saving in cost, because it attains uniform charging by the sole application of a DC voltage.

Only the preferred embodiment of the invention and but a few examples of its versatility are shown and described in the present disclosure. It is to be understood that the invention is capable of use in various other combinations and environments and is capable of changes or modifications within the scope of the inventive concept as expressed herein.

I claim:

1. A charging member, comprising an electroconductive substrate;

an intermediate layer overlying the electroconductive substrate; and a surface layer comprising an aqueous polyurethane resin having a hydrophilic group or segment therein overlying said intermediate layer.

2. The charging member of claim 1, wherein said intermediate layer is in contact with at least one of said substrate and said surface layer.

3. The charging member of claim 1, wherein said intermediate layer comprises an electrically semiconductive material.

4. The charging member of claim 1, wherein said intermediate layer comprises an elastic material.

5. The charging member of claim 1, wherein the aqueous polyurethane resin does not contain a surfactant.

6. The charging member of claim 1, wherein the aqueous polyurethane resin does not contain an electroconductive filler.

7. A charging member comprising:

an electroconductive substrate; and an intermediate layer formed overlying said substrate, said intermediate layer including an epichlorohydrin rubber comprising ECO/EO/AGE.

8. The charging member according to claim 7, wherein the ECO/EO/AGE rubber is in the range of about 40/58/2 to about 60/32/8.

9. The charging member according to claim 8, further including a surface layer, comprising an aqueous polyurethane resin having a hydrophilic group or segment therein, overlying the intermediate layer.

10. The charging member according to claim 9, wherein the aqueous polyurethane resin does not contain a surfactant.

11. The charging member according to claim 9, wherein the aqueous polyurethane resin does not contain an electroconductive filler.

12. The charging member according to claim 8, wherein said intermediate layer comprises an electrically semiconductive material.

13. The charging member according to claim 8, wherein said intermediate layer comprises an elastic material.

14. The charging member according to claim 9, wherein said intermediate layer is in contact with at least one of the substrate and the surface layer.

15. An image forming apparatus, comprising:

a charging member;

an image receiving member;

an exposure unit;

a developing unit;

a transferring unit; and a cleaning station; wherein the charging member comprises:

an electroconductive substrate;

an intermediate layer overlying the electroconductive substrate; and a surface layer, comprising an aqueous polyurethane resin having a hydrophilic group or segment therein, overlying said intermediate layer.

16. The image forming apparatus according to claim 15, wherein the aqueous polyurethane resin does not contain a surfactant.

17. An image forming apparatus, comprising:

a charging member;

an image receiving member;

an exposure unit;

a developing unit;

a transferring unit; and a cleaning station; wherein the charging member comprises:

an electroconductive substrate; and an intermediate layer formed overlying said substrate, said intermediate layer including an epichlorohydrin rubber comprising ECO/EO/AGE.

18. The image forming apparatus according to claim 17, wherein the ECO/EO/AGE rubber is in the range of about 40/58/2 to about 60/32/8.

* * * * *